US005343004A

United States Patent [19]

Chen

[11] Patent Number: 5,343,004

[45] Date of Patent: Aug. 30, 1994

[54] NON-SPARKING ROTATABLE SWITCH APPARATUS

[76] Inventor: Cheng-Nan Chen, No. 12, 18th Road Industry Park, Taichung, Taiwan

[21] Appl. No.: 945,245

[22] Filed: Sep. 15, 1992

[51] Int. Cl.[5] ..... H01H 19/52; H01H 21/72

[52] U.S. Cl. ..... 200/11 R; 200/6 BB; 200/11 C

[58] Field of Search ..... 200/6 BB, 8 R, 8 A, 200/11 R-11 TW, 17 R-18, 51.02-51.06, 51.14-51.17, 564-572; 307/112-141

[56] References Cited

U.S. PATENT DOCUMENTS 2,395,572 2/1946 Meuer et al. ..... 200/6 BB
2,813,158 11/1957 Hutt ..... 200/6 BB
2,841,664 7/1958 Gartland, Jr. et al. ..... 200/18
2,921,147 1/1960 Hutt ..... 200/6 BB

*Primary Examiner*—J. R. Scott
*Attorney, Agent, or Firm*—Bacon & Thomas

[57] ABSTRACT

A non-sparking rotatable switch apparatus for a multi-speed fan includes stationary contacts positioned at two different levels relative to a plane of rotation of the switch. The rotatable portion of the switch apparatus includes upwardly extending contact sheets, some of which extend only to the lower level at which contacts are positioned and at least one of which extends to the higher level at which contacts are positioned. The higher level upwardly extending contact sheets have different widths than the lower level sheets, thereby changing the timing at which the upwardly extending contact sheets engage the respective contacts.

5 Claims, 4 Drawing Sheets

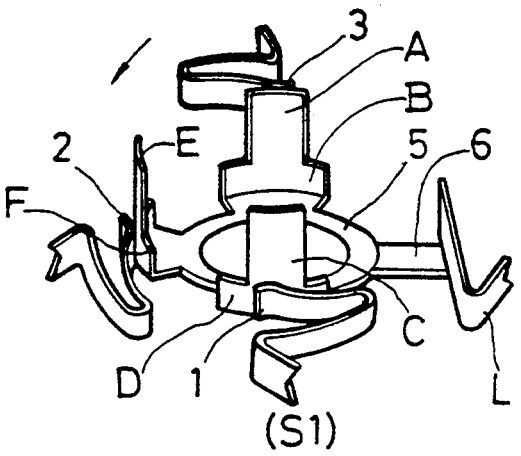
FIG. 4
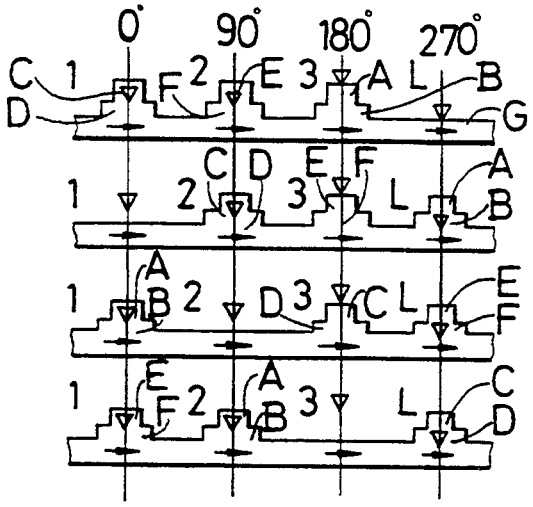

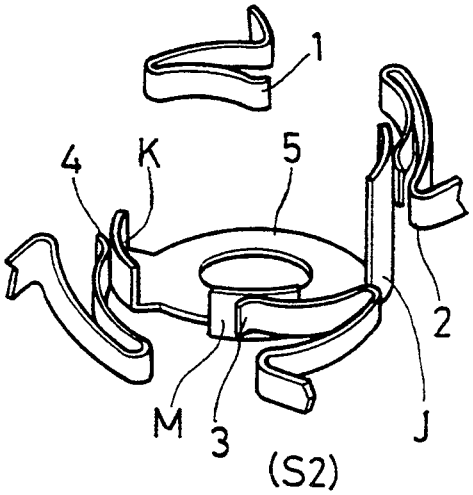
FIG. 6
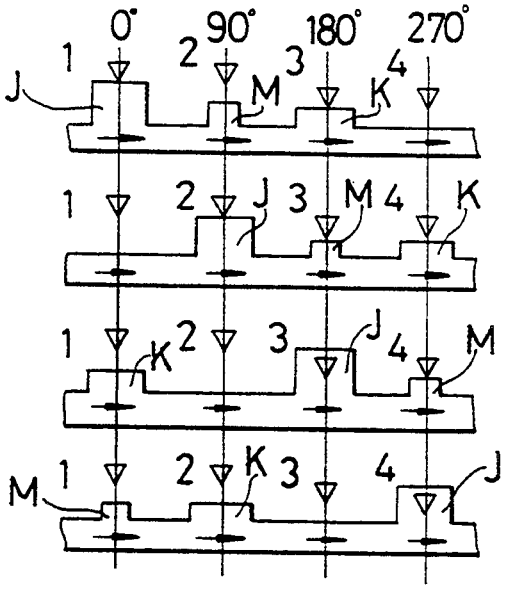
3-1 H.s FIG. 7A
3-2-4 M.s FIG. 7B
3-4 L.s FIG. 7C
3. OFF FIG. 7D

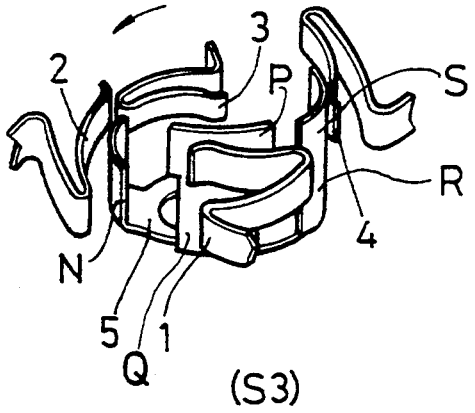
FIG. 8
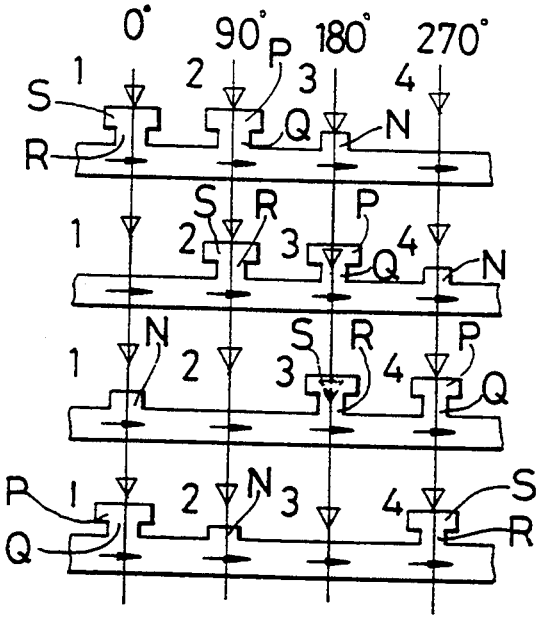
3-1-2 Hs FIG. 9A
3-2 Ms FIG. 9B
3-4(—1) Ls FIG. 9C
3. OFF FIG. 9D

NON-SPARKING ROTATABLE SWITCH APPARATUS

BACKGROUND OF THE INVENTION

This invention relates to a speed changing apparatus, especially a non-sparking circuit apparatus for a multi-speed fan.

There are two types of speed changing apparatus available on the market. One of them achieves the speed changing effect by changing the starting capacitance of the motor and the other by changing the voltage dropping capacitance the motor. For reducing the costs of the capacitors used in these two types of speed changing apparatus, selector switches have been utilized to connect the motor for the fan with two capacitors in parallel to a single capacitor so that a minimum number of capacitors are required. However, in changing the position of the selector switch, the electrical energy can be discharged from a charged capacitor to another one through the selector switch. This discharging effect can result in damage to the capacitors themselves and to the contacts of the selector switch.

The discharge can occur on the following two conditions: (1.) Upon condition that the two capacitors in the circuit of a fan are electrically connected with the power source at a small time differential, one capacitor is charged prior to the other one. In case the circuit involves A.C. of 50 to 60 Hz, the charges in the earlier charged capacitor can be discharged through the switch to the later charged capacitor. In case the ends of the time differential respectively correspond to the positive and negative peaks of the A.C. wave, the discharge would be significant and may form a spark and the resistance to voltage of the capacitors has to be high enough; (2.) Upon condition that one of the two charged parallel capacitors is disconnected from the power source, there will be residue charges on the disconnected capacitor and the phase of the other capacitor will be changed in a very short time. Thereby, the voltage difference between the two capacitors will be increased. In case the time of the disconnection corresponds to the positive peak of the A.C. wave, a significant discharge and a spark can occur between the two capacitors.

OBJECT OF THE INVENTION

It is a general object of the invention to provide a non-sparking circuit apparatus for a multi-speed fan by which the above-mentioned undesirable discharging effect of a capacitor can be avoided.

SUMMARY OF THE INVENTION

The selector switch in accordance with the invention can be used for controlling the connection between the motor and power source and for changing the motor speed by controlling the voltage drop over two capacitors. The construction of the selector switch in accordance with the invention comprises four contacts in the form of elastic sheets and a rotatable, annularly-shaped selector sheet having upwardly extending portions (hereinafter referred to as contact sheets), wherein the four contacts are equally separated by 90 degrees around the selector sheet. The third and fourth contacts of the four contacts are at a lower level relative to the plane of the selector sheet and the first and second contacts are at a higher level, as best illustrated in FIGS. 4, 6 and 8, so that different portions of three contact sheets extending upward from the plane of the selector sheets engage the contacts at different times. The selector sheet is formed with the three contact sheets substantially in a cylindrical surface, wherein the angles between the three contact sheets are 180, 90, and 90 degrees around the perimeter of the main sheet. Each of the two opposite ones of the three contact sheets has a wider width. One of these two contact sheets only extends to the lower level, the other one extends to the higher level, and the third contact sheet also extends to the lower level and has a narrow contact portion so that the four contacts can engage and thereby establish an electrical connection with the selector switch at different times when the latter is rotated. In the first position of the selector switch, the third contact is in connection with the first contact and the motor is directly in connection with the power source and therefore is rotated in its full speed. In the second position of the selector switch, the third contact is in connection with the second and fourth contacts and the motor is connected with the power source through the composite voltage drop provided by the two capacitors. In the third position of the selector switch, the third contact is in connection with the fourth contact and the motor is in connection with the power source through the voltage drop provided by the first capacitor. The two capacitors are connected to the power source through the second and fourth contacts earlier than through the third contact, when the selector switch is rotated from its first position to its second position, because the contact sheet which will be in contact with the third contact is narrower than the other two contact sheets. For the same reason, the two capacitors are disconnected from the power source through the second and fourth contacts later than through the third contact. Thereby, no discharges or sparks will occur between the two capacitors.

BRIEF DESCRIPTION OF THE DRAWINGS

FIG. 4 is a schematic view showing the first embodiment of the selector switch in accordance with the invention;

FIGS. 5A–5D are schematic diagrams illustrating the different positions of the selector switch shown in FIG. 4;

FIG. 6 is a schematic view showing the second embodiment of the selector switch in accordance with the invention;

FIGS. 7A–7D are schematic diagrams illustrating the different positions of the selector switch shown in FIG. 6;

FIG. 8 is a schematic view showing the third embodiment of the selector switch in accordance with the invention; and FIGS. 9A–9D are schematic diagrams illustrating the different positions of the selector switch shown in FIG. 8.

DETAILED DESCRIPTION OF THE PREFERRED EMBODIMENT

Figure 1:
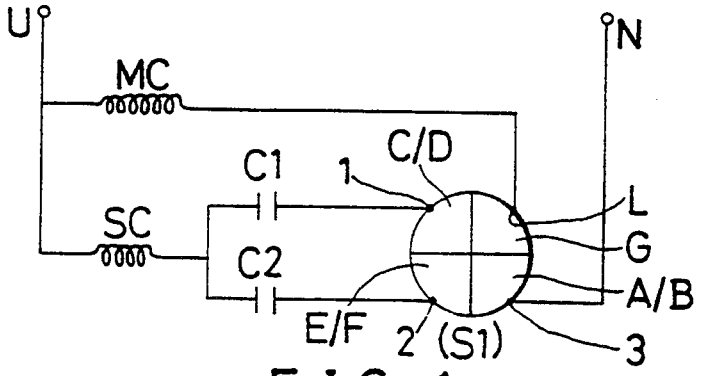
FIG. 1 shows the circuit for use with the first embodiment of the invention.
Figure 2:
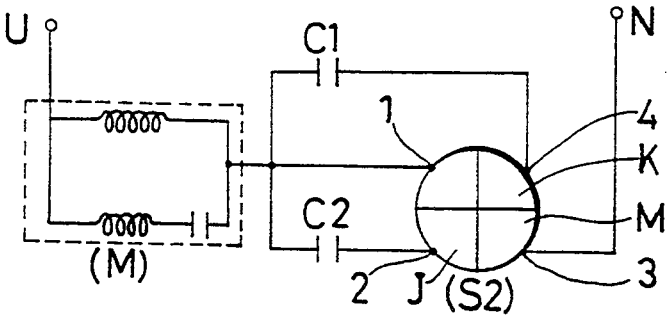
FIG. 2 shows the circuit for use with the second embodiment of the invention.

Referring to FIGS. 1 and 2, there is shown a selector switch S1 which uses two capacitors to change the starting capacitance of the motor. The numerals 1, 2, 3, and the letter L respectively designate the contacts in the selector switch S1. The letters A–F designate portions of contact sheets extending upwardly from the plane of annular portion 5 of the selector switch as best shown in both FIG. 5 and FIGS. 5A–5D. The sheets have wider portions B, D and F adjacent the portions and narrowed portions A, E and C at a higher level further from the sheet. The selector switch S1 has four selecting positions shown, respectively, in FIGS. 5A–5D. In its first position, contact 3 engages portion A and is in connection through respective portions D and F and through an extension G with contacts 1, 2, and L. Therefore, in the first position, the starting capacitance is equal to the sum of the capacitances of capacitors C1 and C2 and this position corresponds to the highest speed of the electrical fan. In the second position of selector switch S1, contact 3 engages portion D, is in connection with contacts 2 and L through respective portions D and B, and the starting capacitance is equal to the capacitance of capacitor C2. In the third position, contact 3 engages portion C and is electrically connected to contacts L and 1 through respective portions F and B, and the starting capacitance is equal to the capacitance of capacitor C1. If the capacitance of capacitor C2 is greater than that of capacitor C1, then the motor speed corresponds to the second position is greater than that corresponding to the third position. Therefore, the second position corresponds to the intermediate speed and third position corresponds to the lowest speed. In the fourth position, contact 3 is not in connection with any other contacts (the other contacts respectively engaging the three upwardly extending contact sheet portions F, B and D) and the power of the motor is off.

Referring to FIG. 2, there is shown a selector switch which uses two capacitors to change the voltage dropping capacitance. The numerals 1, 2, 3, and 4 in FIG. 2 respectively designate the contacts in the selector switch S2. The letters J, K and M designate contact sheets extending upwardly from annular portion 5 of switch S2. Contact sheets K and M extend to a lower level, i.e., a relatively small distance form the plane of portion 5, while sheet J extends to a high level such that sheets M and K can engage both low and high level contacts 1–4, while only sheet J is engageable with high level contacts 1 and 2. From FIGS. 7A–7D, it is apparent that contact sheet K is wider than contact sheet M. The selector switch S2 thus has four selecting positions shown, respectively, in FIGS. 7A–7D. In its first position, contact 1 engages sheet J and is in connection with contact 3 through sheet K, although sheet M does not extend far enough to engage contact 2 and thus contact I is not electrically connected to contact 2. Therefore, in the first position, the power source is in connection with the motor through contact 1 without incurring any voltage dropping and the motor will be in its highest speed. In the second position of the selector switch S2, contact 3 engages sheet M and is in connection with contacts 2 and 4, which respectively engage sheets J and K, and the power source will be in connection with the motor through the parallel capacitors C1 and C2. The voltage dropping caused by these two capacitors decreases the motor speed to its intermediate speed. In the third position, contact 3 engages sheet J and is thereby in connection with contact 4, which engages sheet M, but not with contact 1 which is positioned too high to engage sheet M. In this position, the voltage dropping capacitance is only provided by capacitor C1. Therefore, the motor speed is decreased to its lowest speed. In the fourth position, contact 3 does not engage any of the three sheet J, K or M, and is therefore not in connection with any other contacts and the power of the motor is off.

Figure 3:
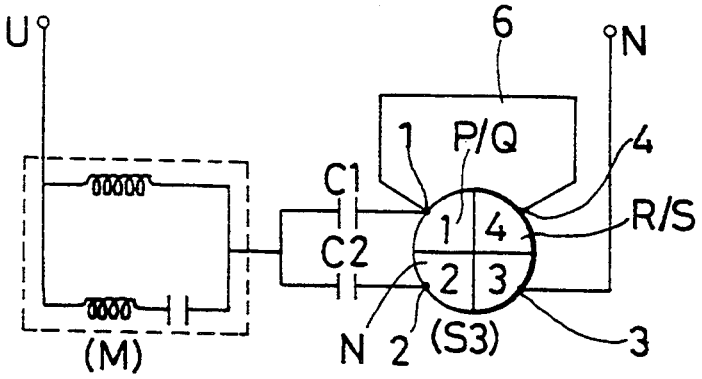
FIG. 3 shows the circuit for use with the third embodiment of the invention.

Referring to FIGS. 3 and 8, there is shown a selector switch which also uses two capacitors to change the voltage dropping capacitance. However, in the circuit shown in FIG. 3, the two capacitors are used to provide three different capacitances. The numerals 1, 2, 3, and 4 in FIG. 3 respectively designate the contacts in the selector switch S3. The letters R and Q represent lower, narrow portions of contact sheets extending upwardly from annular portion 5 and which also include higher, wider portions S and P which extend far enough away from portion S to engage contacts 1, 2 and 4. A lower sheet N, as well as portions R and Q, do not extend far enough to engage contacts 1, 2 or 4, but only can engage contact 3 which is closer to the plane of the sheet than contacts 1, 2 and 4. The selector switch S3 also has four selecting positions shown, respectively, in FIGS. 9A–9B. In its first position, contact 3 engages sheet and is therefore in connection with contacts 1 and 2, which respective engage upper portions S and P, and the voltage dropping capacitance is equal to the sum of the capacitances of capacitors C1 and C2. In the second position, contact 3 engages portion Q and is in connection with contact 2 through portion S, and the voltage dropping capacitance is equal to the capacitance of capacitor C2. In the third position, the contact 3 engages portion R and is in connection with contact 4 through portion P which is in connection with contact 1 through a direct connection 6 between contacts 1 and 4, as shown in FIG. 3, and the voltage dropping capacitance is equal to the capacitance of capacitor C1. If the capacitance of C2 is greater than that of C1, then the second position corresponds to the intermediate motor speed and the third position corresponds to the lowest motor speed. In the fourth position, contact 3 in not in connection with any other contacts, and the power of the motor is off.

The selector switch S1 shown in FIG. 4 can be used in the circuit shown in FIG. 1 for controlling capacitors C1, C2 and the continuous variation of main coil MC and starting coil SC of the motor. In the circuit, one end of main coil and one end of starting coil are commonly connected to one terminal U of the power source. The other end of main coil MC is connected with contact L of selector switch S1. The other end of starting coil SC is in connection with two capacitors C1 and C2. These two capacitors C1 and C2 are respectively in connection with contacts I and 2. The other terminal N of the power source is connected with contact 3. The construction of selector switch S1, as shown in FIG. 4, comprises four contacts 1, 2, 3, and L in the form of elastic sheets and a rotatable selector sheet 5, wherein contacts 1, 2, 3, and L are equally separated by 90 degrees around selector sheet 5 and contact L is always in electrical connection with selector sheet 5. As explained above, contacts 1 and 2 are at a lower level and contact 3 is at a higher level. Selector sheet 5 is formed with the three contact sheets 1, 2 and 3 substantially in a cylindrical surface wherein the angles between the sheets are 180, 90, and 90 degrees. Each of the three contact sheets consists of a narrow portion A, C, E at the higher level and a wide portion B, D, F at the lower level so that the contacts 1, 2, and 3 can engage and thereby become electrically connected to selector switch at different times. As illustrated in the time sequence diagram shown in FIGS. 5A–5D, contacts 1, and 2, which are in connection with capacitors C1 and C2, are at the lower level at which the wide portions of the contact sheets are formed. Contact 3, which is in connection with the power source, is at the higher level, further from the plane of the selector sheet portion 5 at which the narrow portions of the contacts are formed. As a result, contacts 1 and 2 engage and disengage from the selector switch 4 earlier than contact 3 when selector switch 4 is rotated. Therefore, no voltage drop will form between contacts 1 and 2 and no discharges and sparks occur between them.

The selector switch S2 shown in FIG. 6 can be used in the circuit shown in FIG. 2 for controlling the connection between the motor and power source and for changing the motor speed by controlling the voltage drop over capacitors C1 and C2. In the circuit, one end of the motor M is connected with one terminal U of the power source and the other end of the motor M is connected in three parallel lines with contact 1 of selector switch S2, and with contacts 4 and 2 through capacitors C1, and C2. Contact 3 is connected to the other terminal N of the power source. The construction of selector switch S2, as explained above and shown in FIG. 6, comprises four contacts 1, 2, 3, and 4 in the form of elastic sheets and a rotatable selector sheet 5, wherein contacts 1, 2, 3, and 4 are equally separated by 90 degrees around selector sheet 5. Contacts 3 and 4 are at a lower level and contacts 1 and 2 are at a higher level. Selector sheet 5 is formed with three contact sheets J, K and M substantially in a cylindrical surface, wherein the angles between the three contact sheets are 180, 90, and 90 degrees. Each of the two opposite ones of the three contact sheets, i.e., contact sheets J and K has a wider width. One of these two wider contact sheets only extends to the lower level (sheet K), while the other one (sheet J) extends to the higher level, and the third contact sheet (sheet M) also extends to the lower level and has a narrow contact portion so that the contacts 1, 2, 3, and 4 can engage and disengage, and thereby become electrically connected to or from, selector switch 5 at different times when the latter is rotated. As illustrated in the time sequence diagram shown in FIGS. 7A–7D, in the first position of selector switch 5, contact 3 is in connection with contact 1 and the motor M is directly in connection with the power source and therefore is rotated in its full speed. In the second position of selector switch 5, contact 3 is in connection with contacts 2 and 4 and the motor M is connected with the power source through the composite voltage drop provided by capacitors C1 and C2. In the third position of selector switch 5, contact 3 is in connection with contact 4 and the motor M is in connection with the power source through the voltage drop provided by capacitor C1. From the time sequence shown in FIGS. 7A–7D, it is apparent that capacitors C1 and C2 are electrically connected with the power source through switch 52 and contacts 2 and 4 earlier than is contact 3, when selector switch 5 is rotated from its first position to its second position, because the contact sheet M which will be in contact with contact 3 is narrower than the other two contact sheets J and K. For the same reason, the capacitors C1 and C2 can get out of connection with the power source through contacts 2 and 4 later than contact 3. As a result, no discharges or sparks will occur between capacitors C1 and C2.

The selector switch S3 shown in FIG. 8 can be used in the circuit shown in FIG. 3 for controlling the connection between the motor and power source and for changing the motor speed by controlling the voltage drop over capacitors C1 and C2. In the circuit, one end of the motor M is connected with one terminal U of the power source and the other end of the motor M is connected in two parallel lines with contacts I and 2 through capacitors C1, and C2. Contact 4 is connected with contact 1 and contact 3 is connected to the other terminal N of the power source. The construction of selector switch S3, as shown in FIG. 8, comprises four contacts 1, 2, 3, and 4 in the form of elastic sheets and a rotatable selector sheet 5, wherein contacts 1, 2, 3, and 4 are equally separated by 90 degrees around selector sheet 5. Contacts 1, 2, and 4 are at the same higher level and contact 3 is at a lower level. Selector sheet 5 is formed with three contact sheets substantially in a cylindrical surface wherein the angles between the three contact sheets are 180, 90, and 90 degrees. Two adjacent ones of the three contact sheets extend to the higher level and each of them has a wide portion P, S at the higher level and a narrow portion Q, R at the lower level. The other contact sheet (sheet N) extends to the lower level and has a narrow width. Therefore, the contacts 1, 2, 3, and 4 can engage and therefore be in electrical connection with selector switch 5 at different times when the latter is rotated. As illustrated in the time sequence diagram-shown is FIGS. 9A–9D, in the first position of selector switch 5, contact 3 is in connection with contacts 1 and 2 and the motor M is in connection with the power source through capacitors C1 and C2. In the second position of selector switch 5, contact 3 is in connection with contact 2 and the motor M is connected with the power source over the composite voltage drop provided by capacitors C2. In the third position of selector switch 5, contact 3 is in connection with contact 4 which is connected directly with contact 1 through a wire 6 and the motor M is in connection with the power source over the voltage drop provided by capacitor C1. In the fourth position, contact 3 is not in connection with any other contacts and the power of the motor M is off. If the capacitance of capacitor C2 is twice that of capacitor C1, then the three positions correspond to three motor speeds. Moreover, from the time sequence shown in FIGS. 9A–9D, it is apparent that capacitors C1 and C2 are connected with the power source through contacts 1 and 2 earlier than is contact 3 when selector switch 5 is rotated from its fourth position into its first position, because the contact portion N which will be in contact with contact 3 is narrower than the contact portions (S, P) of the other two contact sheets which will be in contact with contacts 1 and 2, as shown in FIG. 9A. For the same reason, the capacitors C1 and C2 are disconnected from the power source through contacts 1 and 2 later than through contact 3. As a result, no discharges or sparks will occur between capacitors C1 and C2.

While the invention has been particularly shown and described with reference to the three preferred embodiments thereof, it will be understood by those skilled in the art that changes within the purview of the appended claims may be made without departing from the true scope and spirit of the invention in its broader aspects.

What is claimed is:

1. A rotatable switch apparatus for a multi-speed fan, comprising:

four stationary contacts each in the form of an elastic sheet, said contacts being arranged to be connected with different components in the fan; and a planar selector sheet arranged to be rotatable in the plane of the selector sheet to electrically connect different ones of the contacts with each other through said selector sheet, and thereby to electrically connect any components to which the contacts are connected with each other, wherein said contacts are positioned around a perimeter of said sheet at two different levels, a higher level being at a further distance from said sheet than a lower level, wherein said rotatable selector sheet includes upwardly extending contact sheets, at least one of which extends only to said lower level to engage only contacts positioned at said lower level, and a second one of which extends to said higher level to engage contacts positioned at both said lower and higher levels; and wherein at least a portion of the contact sheet which extends to the higher level has a different width than the contact sheet which extends to the lower level such that, as the selector sheet is rotated, a time of engagement between a higher level contact and one of the contact sheets is different from a time of engagement between a lower level contact and one of the contact sheets.

2. Apparatus as claimed in claim 1, wherein a number of said contacts is four, and one of said four contacts is positioned to always be in engagement with said selector sheet, a second one of said four contacts is at said higher level, and the remaining two of said contacts are located at said lower level, and wherein said selector sheet includes three of said contact sheets, each of which has a narrow contact portion at said higher level and a wide contact portion at said lower level.

3. Apparatus as claimed in claim 1, wherein a number of said contacts is four and two of said four contacts are located at said higher level and two of said contacts are located at said lower level, and wherein said selector sheet includes three contact sheets, only one of which extends to said upper level, the other two extending only to said lower level, one of the sheets extending to the lower level being relatively narrow in comparison with the other two sheets.

4. Apparatus as claimed in claim 1, wherein a number of said contacts is four, three of said four contacts extending to said higher level and one of said contacts being positioned on said lower level, wherein said selector sheet includes three contact sheets, one of which extends only to said lower level and two of which extend to said higher level and have higher level portions which are wider than lower level portions thereof, said higher level portions also being wider than said contact sheet which extends only to said lower level.

5. Apparatus as claimed in claim 1, wherein a number of said contacts is four and said components include two capacitors and a power source for the multi-speed fan, and wherein two of said four contacts are electrically connected to the two capacitors respectively, and another one of said four contacts is electrically connected to the power source for the multi-speed fan.

* * * * *